US005564497A

United States Patent [19]

Fukuoka et al.

[11] Patent Number: 5,564,497

[45] Date of Patent: Oct. 15, 1996

[54] CORRUGATED FIN TYPE HEAD EXCHANGER

[75] Inventors: Mikio Fukuoka, Bisai; Yoshifumi Aki, Kariya, both of Japan

[73] Assignee: Nippondenso Co., Ltd., Kariya, Japan

[21] Appl. No.: 552,979

[22] Filed: Nov. 3, 1995

[30] Foreign Application Priority Data

Nov. 4, 1994 [JP] Japan ..... 6-270833

[51] Int. Cl.[6] ..... F28D 1/04

[52] U.S. Cl. ..... 165/152; 165/153; 165/DIG. 487; 165/DIG. 505

[58] Field of Search ..... 165/152, 153, 165/DIG. 487, DIG. 505

[56] References Cited

U.S. PATENT DOCUMENTS

| | | | |
|---|---|---|---|
| 4,332,293 | 6/1982 | Hiramatsu | 165/153 |
| 4,483,390 | 11/1984 | Araya et al. | 165/104.32 |
| 4,693,307 | 9/1987 | Scarselletta | 165/152 |
| 4,825,941 | 5/1989 | Hoshino et al. | 165/110 |
| 4,998,580 | 3/1991 | Guntly et al. | 165/133 |
| 5,076,354 | 12/1991 | Nishishita | 165/146 |
| 5,186,249 | 2/1993 | Bhatti et al. | 165/174 |
| 5,311,935 | 5/1994 | Yamamoto et al. . | |

*Primary Examiner*—Allen J. Flanigan
*Attorney, Agent, or Firm*—Cushman, Darby & Cushman

[57] ABSTRACT

According to the present invention, in a corrugated fin type heat exchanger including a core portion having a plurality of flat tubes disposed in parallel relation with regard to a flow direction of air and at least one corrugated fin disposed between each pair of the flat tubes, a height of a flow space within the flat tube is in a range of 0.6–1.2 mm, a height of the corrugated fin is in a range of 3–6 mm, and a ratio (St/W×D) of the cross-sectional area (W×D) expressed by an overall width dimension (W) and a thickness dimension (D) of the core portion to a total cross-sectional flow passage area (St) of the plurality of flat tubes is set to a range of 0.07–0.24 according to the height of the flow space of the flat tube and the height of the corrugated fin. In this way, it is possible to reduce the Reynold's number of the flow passages within the flat tubes to maintain a constant region irrespective of the variation in the hot water flow quantity, thereby reducing the variation in the water side heat transfer rate.

8 Claims, 11 Drawing Sheets

CORRUGATED FIN TYPE HEAD EXCHANGER

CROSS REFERENCE TO RELATED APPLICATION

The present application is based on and claims priority from Japanese application No. 6-270833 filed on Nov. 4, 1994, the content of which is incorporated herein by reference.

BACKGROUND OF THE INVENTION

1. Field of the Invention

The present invention generally relates to a corrugated fin type heat exchanger for heating air by heat exchanging hot water with the air, and is preferably applied to a corrugated fin type heat exchanger used in an automotive air conditioner in which hot water flow quantity widely varies.

2. Related Art

In a vehicle, as illustrated in FIG. 1, a heat exchanger 2 for heating is installed in a cooling water (hot water) circuit of an engine 1 for running the vehicle. Hot water is circulated into the heat exchanger 2 by a water pump 3 driven by the engine 1, and the flow quantity of the hot water flowing from a flow quantity control valve 4 into the heat exchange 2 is controlled to adjust the temperature of the air flow of the heat exchanger 2.

Engine cooling water is circulated into a radiator 6 by the water pump 3 through a thermostat 5 to cool the engine cooling water within the radiator 6. The thermostat is a well-known device, in which a valve opens when the cooling water temperature rises to or exceeds a predetermined temperature, thereby the cooling water flowing into the radiator 6.

The reference numeral 7 denotes a bypass circuit for the engine cooling water; numeral 8 denotes a radiator side circuit; and numeral 9 denotes a heater side circuit. The water pump 3 circulates the cooling water through all of these circuits 7, 8 and 9.

However, as the water pump 3 is driven by the engine 1, a rotational speed of the water pump 3 largely varies according to the rotational speed of the engine 1, i.e., the vehicle speed, and thereby flow quantity of the hot water into the heat exchanger 2 largely varies.

As a result of such large variation in the flow quantity of the hot water into the exchanger 2, when the vehicle is running at a low speed (when the hot water flow quantity is small), as illustrated in FIG. 2, there is a problem in that the heat radiation performance of the heat exchanger 2 is extremely deteriorated.

In FIG. 2, the ordinate represents the heat radiation performance Q of the heat exchanger 2, the abscissa represents the flow quantity Vw of the hot water into the heat exchanger 2. As can be seen from FIG. 2, the hot water flow quantity is 16 lit/min when the vehicle is running at 60 km/h, and the hot water flow quantity is 4 lit/min when the vehicle is in idling. As the hot water flow quantity decreases, the heat radiation performance when the vehicle is idling falls by 22% as compared to when the vehicle is running at 60 km/h. As a result, heat generation is reduced.

Particularly when the vehicle is running on urban streets, the vehicle is subjected to frequent starts and stops due to traffic signals. Therefore, whenever the vehicle engine is idling, there is insufficient heat for the passengers.

The inventors of the present invention have studied the cause of such deterioration of the heat radiation performance from various points of view and have determined the following.

As illustrated in FIG. 3, the heat exchanger 2 includes a plurality of flat tubes 2*a* arranged in parallel with the air flow direction. These flat tubes 2*a* are individually disposed in a single row in the air flow direction. Corrugated fins 2*b* are disposed between each pair of flat tubes 2*a*, thereby configuring a corrugated type heat exchanger. The reference numeral 2*c* denotes a core portion which is composed of the flat tubes 2*a* and the corrugated fins 2*b*.

In FIG. 4, the ordinate represents water side heat transfer rate αw of the flat tube 2*a*, and the abscissa represents the Reynold's number Re and hot water flow quantity Vw of the hot water passages formed with the flat tubes 2*a*.

As understood from FIG. 4, the Reynold's number is within range of 500–2200 when the hot water flowing into the heat exchanger 2 is within a predetermined range (16 lit/min when the vehicle is running at 60 km/h, and 4 lit/min when the vehicle is idling), and the heat exchanger 2 is operated to the extent from the laminar region to a transition flow region. For this reason, the water side heat transfer rate αw largely varies in accordance with the variation of the hot water flow quantity. As a result, it turned out that the water side heat transfer rate αw largely falls within the low flow quantity region, thereby causing the deterioration of the heat radiation performance when the vehicle is idling.

FIG. 4 illustrates the results of an experiment in which normal tubes with no dimples (concave and convex portion) for facilitating the turbulence of the hot water on the inner surfaces were used as the flat tubes 2*a*.

For improving the water side heat transfer rate αw, in general, the turbulence of the hot water within the tubes is often facilitated. Concretely, it has been proposed that a turbulence generator for facilitating turbulence is inserted into the tubes, or dimples are formed on the inner surfaces of the tubes to facilitate turbulence.

Therefore, the inventors of the present invention have measured the water side heat transfer rate αw by using the flat tubes 2*a* with dimples for facilitating turbulence. As a result, as illustrated in FIG. 5, the flat tube with dimples could generally improve the water side heat transfer rate αw as compared to the normal tube, and the Reynold's number Re of the dimple tube in the transition region from laminar to turbulence decreased from 1400 with the normal tube to 1000.

However, the large variation in the water side heat transfer rate αw according to the hot water flow quantity still remained even when the flat tube with dimples is used. Therefore, even when a technique for facilitating a turbulence such as the flat tubes with dimples is used, it is not possible to solve the problem of reduced heat radiation performance when the hot water flow quantity is small (when the vehicle is running at a low speed).

SUMMARY OF THE INVENTION

In view of the above problems, an object of the present invention is to provide a corrugated type heat exchanger which can effectively improve the heat radiation performance within a low flow quantity region.

As understood from FIGS. 4 and 5, when the Reynold's number of approximately 1000 was taken as a transition point, the variation (inclination) of the water side heat transfer rate αw against the Reynold's number within the laminar region was very small in the region with the Reynold's number of 1000 or less.

In consideration of such small variation (inclination) of the water side heat transfer rate αw within the laminar region, in the present invention, the Reynold's number of the flow passages of the flat tubes is set to be extremely small. This keeps water flow in the flow passages of the flat tubes in a complete laminar region over the regular use range of the hot water flow quantity from the high flow quantity region to the low flow quantity region. As a result, the variation in the water side heat transfer rate αw is reduced and the water side heat transfer rate αw is increased simultaneously to improve the heat radiation performance within the low flow quantity region.

According to the present invention, in a corrugated fin type heat exchanger including a core portion having a plurality of flat tubes disposed in parallel with flow direction of the air and at least one corrugated fin disposed between each pair of the flat tubes, a height of the flow space within the flat tube is in a range of 0.6–1.2 mm, a height of the corrugated fin is in a range of 3–6 mm. Further, a ratio (St/W×D) of the cross-sectional area (W×D) expressed by an overall width dimension (W) and a thickness dimension (D) of the core portion to a total cross-sectional flow passage area (St) of the plurality of flat tubes is set to a range of 0.07–0.24 according to the height of the flow space within the flat tube and the height of the corrugate fin.

It is preferable that the Reynold's number be set to 1000 or less when flow quantity of the hot water passing through the core portion is 16 lit/min.

Further, it is preferable that the flat tubes and the corrugated fins be made of aluminum, a wall thickness of the flat tube be set to a range of 0.2–0.4 mm, and a wall thickness of the corrugated fin be set to a range of 0.04–0.08 mm.

According to the present invention as disclosed above, it is possible to reduce the Reynold's number of the flow passages of the flat tubes and to keep the laminar region constant even if the hot water flow quantity widely varies. As a result, the variation in the water side heat transfer rate can be reduced.

Furthermore, it is possible to improve the 1*b* water side heat transfer rate sufficiently by setting the height of the flow space within the flat tube to a dimension in a range of 0.6–1.2 mm, and to improve the heat radiation performance by setting the height (Hf) of the corrugated fin to the optimum range in a range of 3–6 mm.

As a result, even in the low flow quantity region of the hot water flow quantity, it is possible to greatly improve the heat radiation performance as compared to the conventional type, thereby providing sufficient heat to the passenger.

Particularly in an automotive air conditioning system, since the hot water flow quantity frequently varies due to the repetition of starts and stops of a vehicle, the improvement in heating as described above is extremely useful.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS

An embodiment of the present invention will now be described with reference to the drawings.

Figure 3:
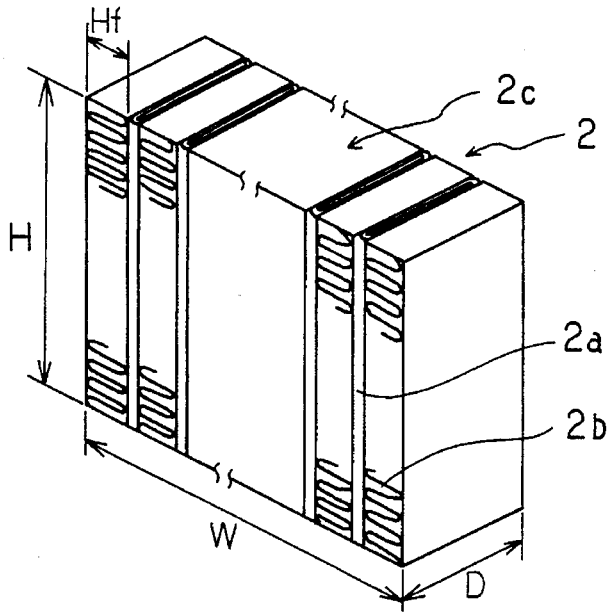
FIG. 3 is a perspective view illustrating the core portion of a heat exchanger of an embodiment according to the present invention.
Figure 4:
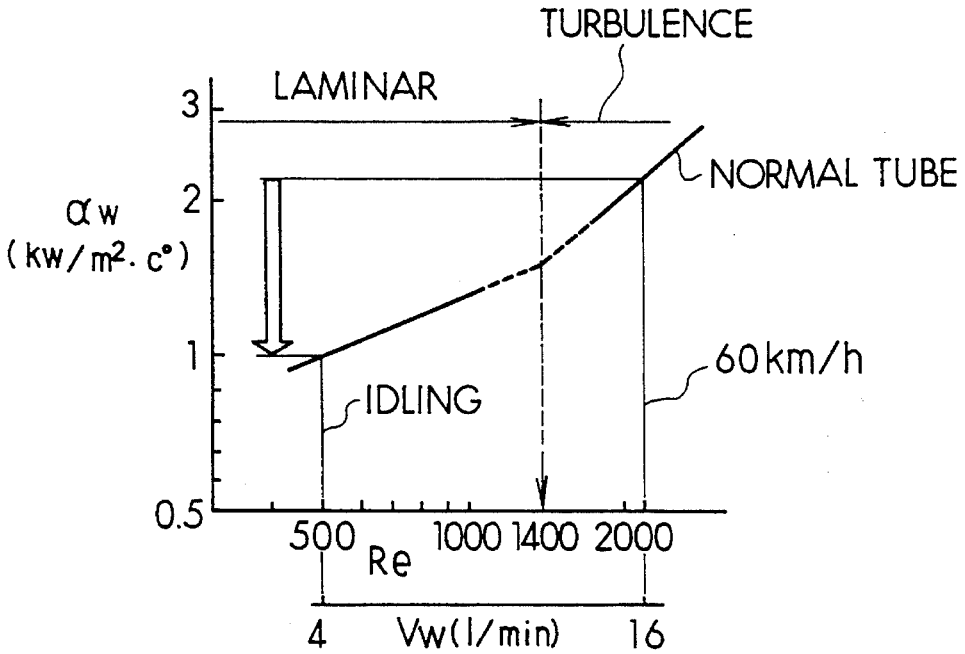
FIG. 4 PRIOR ART
FIG. 4 is a graph illustrating the relationship among the hot water flow quantity, Reynold's number and water side heat transfer rate of the conventional heat exchanger.

In FIG. 3, dimensions W (width), D (thickness) and H (height) of the core portion 2*c* of the heat exchanger 2 are generally set as W=100–300 mm, D=16–42 mm and H=100–300 mm in consideration of mounting the heat exchanger 2 easily within a heater unit housing of an automotive air conditioning system and of the required heat radiation performance.

Figure 6:
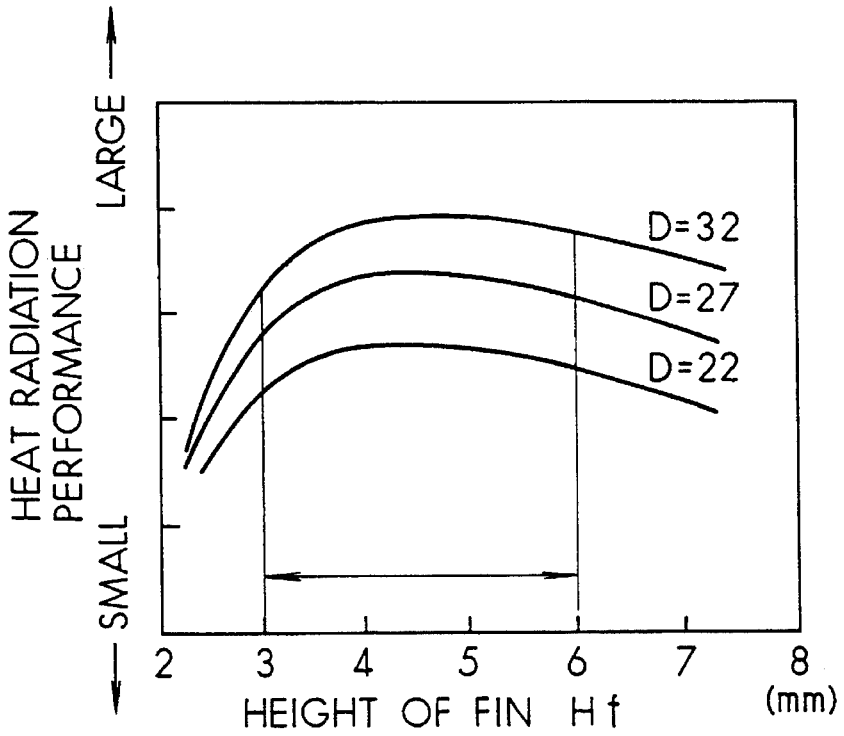
FIG. 6 is a graph illustrating the relationship between the corrugated fin height and heat radiation performance of the heat exchanger of the embodiment according to the present invention.

As illustrated in FIG. 6, it is optimized that the height Hf of a corrugated fin 2*b* is set in a range of 3–6 mm with 4.5 mm being the center of the range, in consideration of the heat radiation performance, which is described in the Japanese Unexamined Patent Publication No. 5-196383, the content of which is incorporated herein by reference.

To keep the flow passages within the flat tubes 2*a* laminar by setting the Reynold's number Re to a small value, the flow velocity v of hot water within the flat tubes 2*a* and the equivalent diameter de of the flat tube 2*a* should be reduced by using the following equation (1).

$$Re=v\cdot de/\nu \quad (1)$$

where ν is the kinematic viscosity of the hot water within the flat tubes 2*a*, and the substantial round-hole diameter de of the flat tube 2*a* is the diameter of the round-hole having the same area as the cross-sectional area of the flat tube 2*a*.

To reduce the flow velocity v of the hot water within the flat tubes 2*a*, the total area St of the flow passages of the flat tubes 2*a* should be increased by using the following equation (2).

$$v=Vw/St \quad (2)$$

where Vw is the flow quantity of the hot water flowing into the heat exchanger 2 and St is the sum total of the cross-sectional areas of the flow passages within all the flat tubes 2*a* of the core portion 2*c*.

To reduce the substantial diameter de of the flat tube 2*a*, the cross-sectional area A of the flow passage per flat tube 2*a* should be reduced by using the following equation 3.

$$de=4\cdot A/L \quad (3)$$

where L is the wet edge length within the flat tube 2*a* (the length of the inner peripheral wall of the cross-sectional shape of the flat tube 2*a*, which will be described later with reference to FIGS. 7 and 8).

A liquid mixture of an antifreeze solution containing a rust preventive and water combined approximately 50:50 is generally used as the hot water (engine cooling water) circulating into the heat exchanger 2, and the hot water temperature is maintained to approximately 85° C. by the thermostat 5.

Here, the reduction of the cross-sectional flow passage area A per flat tube 2*a* and the increase of the total cross-sectional flow passage area St of the flat tubes 2*a* are contrary concepts. Therefore, to increase the total cross-sectional tube area St while reducing the cross-sectional flow passage area A per flat tube 2*a*, it is preferable that the core portion 2*c* of the following construction being employed.

The core portion 2*c* should be a one way flow type (full-pass type) having the cross-sectional area (W×D) of the core portion 2*c* in which the hot water flows only in one direction instead of U-turn direction in which the hot water flows in a U-turn, and the number of the flat tubes 2*a* having the cross-sectional area (W×D) of the core portion 2*c*, through which the hot water flows in parallel, should be increased. The concrete structure of the core portion 2*c* of the one way flow type (full-pass type) will be described later with reference to FIG. 15.

Figure 5:
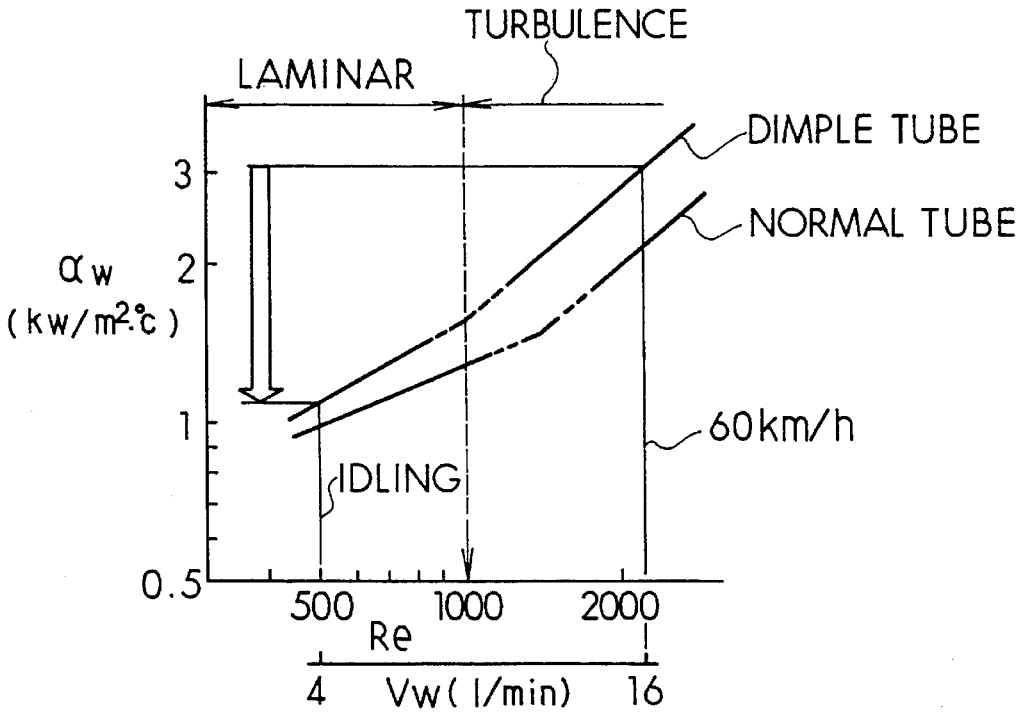
FIG. 5 is a graph illustrating the relationship among the hot water flow quantity, Reynold's number and water side heat transfer rate of another conventional heat exchanger.

Next, for the core portion 2*c* dimensioned to W (width)=180 mm, H (height)=180 mm and D (thickness)=27 mm, the inventors of the present invention examined the total cross-sectional flow passage area St of the flat tubes 2*a* which could hold the Reynold's number Re to be 1000 or less (within the complete laminar region in FIG. 5) until the hot water flow quantity Vw increases to 16 lit/min, which is a flow quantity when the vehicle is running at a speed of 60 km/h.

Figure 7:
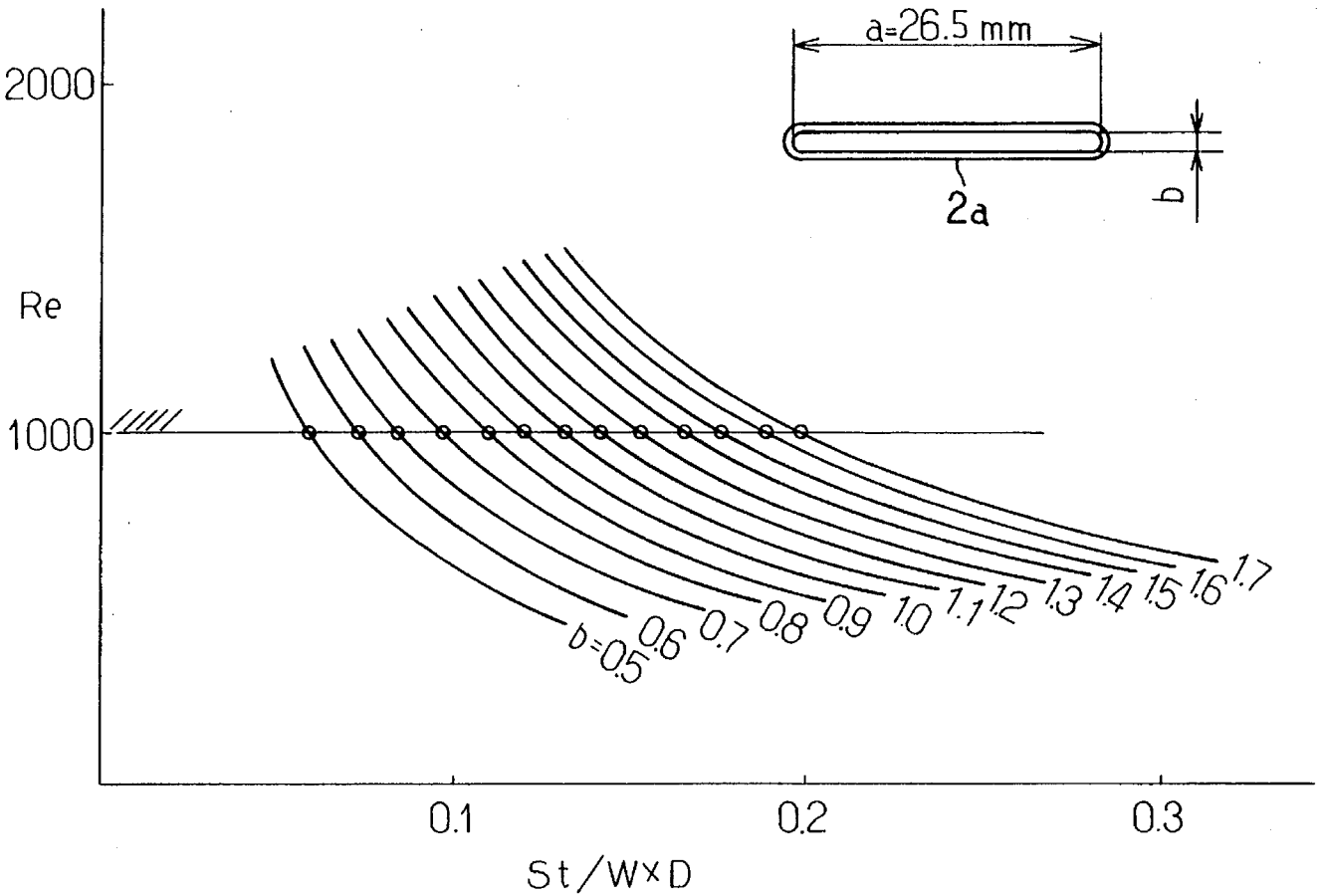
FIG. 7 is a graph illustrating the relationship between the total cross-sectional area ratio of flat tubes and Reynold's number of the heat exchanger of the embodiment according to the present invention.

Since the total cross-sectional flow passage area St of the flat tubes 2*a* varies according to the size (W, D) of the core portion 2*c*, the inventors examined the relationship between the ratio (St/W×D) of the total cross-sectional flow passage area St of the flat tubes 2*a* to the cross-sectional area of the core portion 2*c* (W×D) and the Reynold's number Re as a parameter of the inner thickness b of the flat tube 2*a* within a range of 0.5–1.7, as illustrated in FIG. 7. In FIG. 7, the abscissa represents the ratio (St/W×D) and the ordinate represent the Reynold's number Re.

Figure 8:
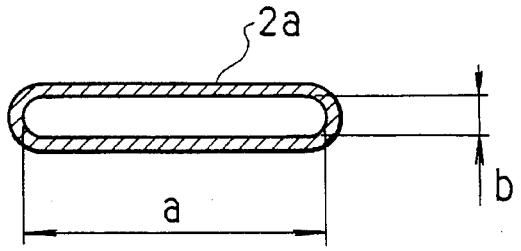
FIG. 8 is a cross-sectional view illustrating the flat tube of the heat exchanger of the embodiment according to the present invention.

The height "b" of the flow space within the flat tube 2*a* means the height in the short side direction of the flow passage within the flat tube 2*a* as shown in cross-section in FIG. 8. The width dimension of the long side direction is indicated as "a".

In the experiment which result is illustrated in FIG. 7, the inner width "a" of the flat tube 2*a* was fixed to 26.5 mm and the height "b" was changed.

The ratio (St/W×D) with respect to each height "b" of the flat tube 2*a*, where the Reynold's number Re is 1000, is indicated with 0. As illustrated in FIG. 7, the ratio (St/W×D) with respect to each height "b" of the flat tube 2*a* where the Reynold's number Re is 1000 or less exists in a large number.

Therefore, the inventors of the present invention also studied the optimum height "b" of the flat tube 2*a* in view of its performance, and further studied the relationship between the optimum height "b" and the total cross-sectional flow passage area St of the flat tubes 2*a*.

Specifically, the inventors studied on the core portion 2*c* with the width W=180 mm, the height H=180 mm and the height D=27 mm, and the fin height Hf being the central value 4.5 mm of the optimum range (3–6 mm) to optimize the thickness "b" of the flat tube 2*a* in view of its performance.

Figure 9:
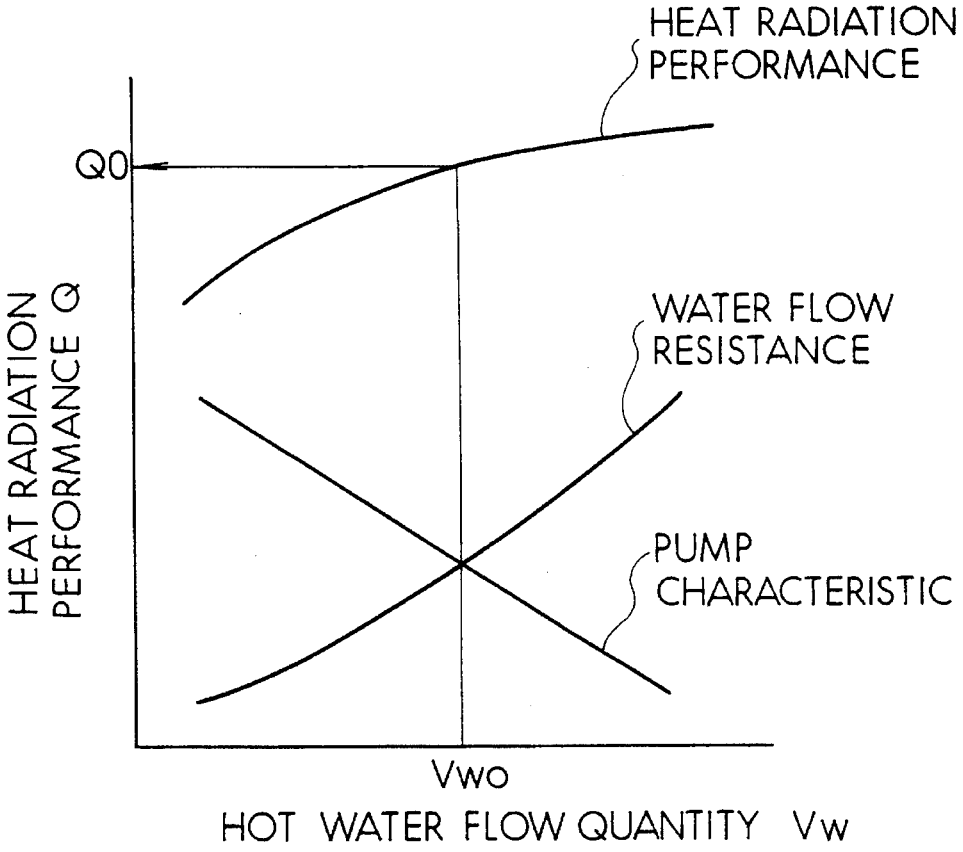
FIG. 9 is a graph illustrating the relationship between the hot water flow quantity and heat radiation performance of the heat exchanger of the embodiment according to the present invention.

In FIG. 9, the ordinate represents the heat radiation performance Q of the heat exchanger 2 and the abscissa represents the flow quantity Vw of the hot water circulating into the heat exchanger 2. The heat radiation performance Qo with the hot water flow quantity Vwo determined according to the matching point of the water flow resistance of the heat exchanger 2 and the pump characteristics of a water pump 3 of an engine 1 corresponds to the performance of the heat exchanger 2 in actual operation.

Figure 10A:
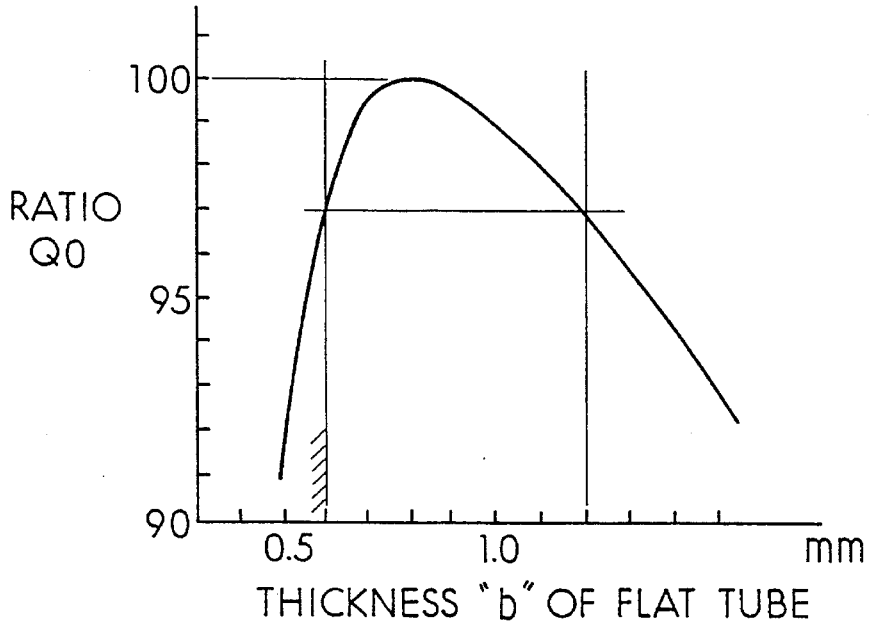
FIG. 10A is a graph illustrating the relationship between the inner thickness of flat tube and heat radiation performance of the heat exchanger of the embodiment according to the present invention.

The heat radiability Qo of the heat exchanger 2 in an actual operation is obtained by varying the height "b" of the flat tube 2*a* and is summarized in FIG. 10A. In FIG. 10A, the heat radiation performance Qo of the height b=0.7 mm at which the heat radiation performance Qo of the heat exchanger 2 in an actual operation is the highest, is set to 100. The ordinate represents the percentage of the heat radiation performance Qo of each height "b" of the flat tube 2*a* against the heat radiation performance Qo=100 of such height b=0.7 mm of the flat tube 2*a*.

It is understood from FIG. 10A that the optimum range of the height "b" of the flat tube 2*a* is 0.6–1.2 mm.

Figure 10B:
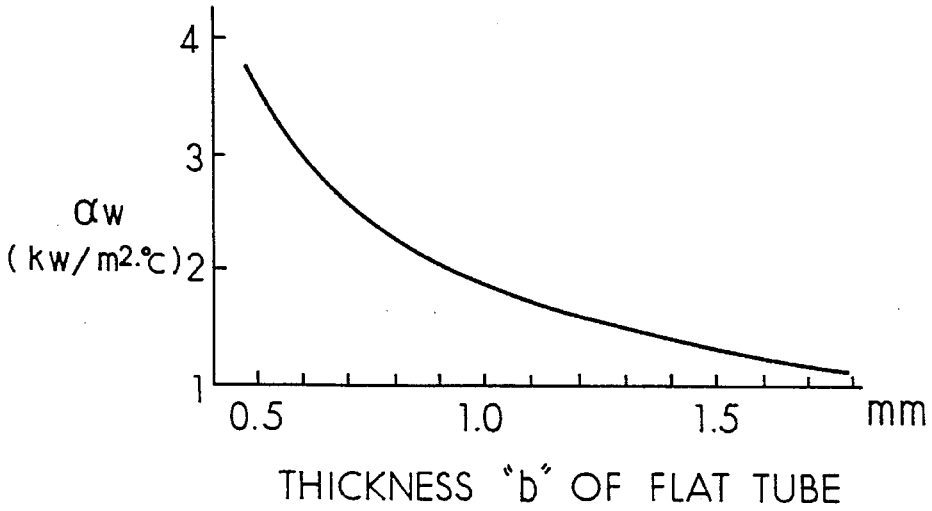
FIG. 10B is a graph illustrating the relationship between the inner thickness of the flat tube and water side heat transfer rate of the heat exchanger of the embodiment according to the present invention.

FIG. 10B illustrates the relationship between the height b of the flat tube 2*a* and water side heat transfer rate αw with the Reynold's number Re=500. The smaller the dimension "b" is, the higher the water side heat transfer rate αw is. As a matter of fact, however, when the dimension "b" decreases, the inner resistance of the flat tube 2*a* increases. Resultantly, the flow quantity of the circulating hot water decreases, and the heat radiation performance is deteriorated, as illustrated in FIG. 10A. Therefore, it is necessary to set the lower limit of the height "b" to 0.6 mm.

Figure 11:
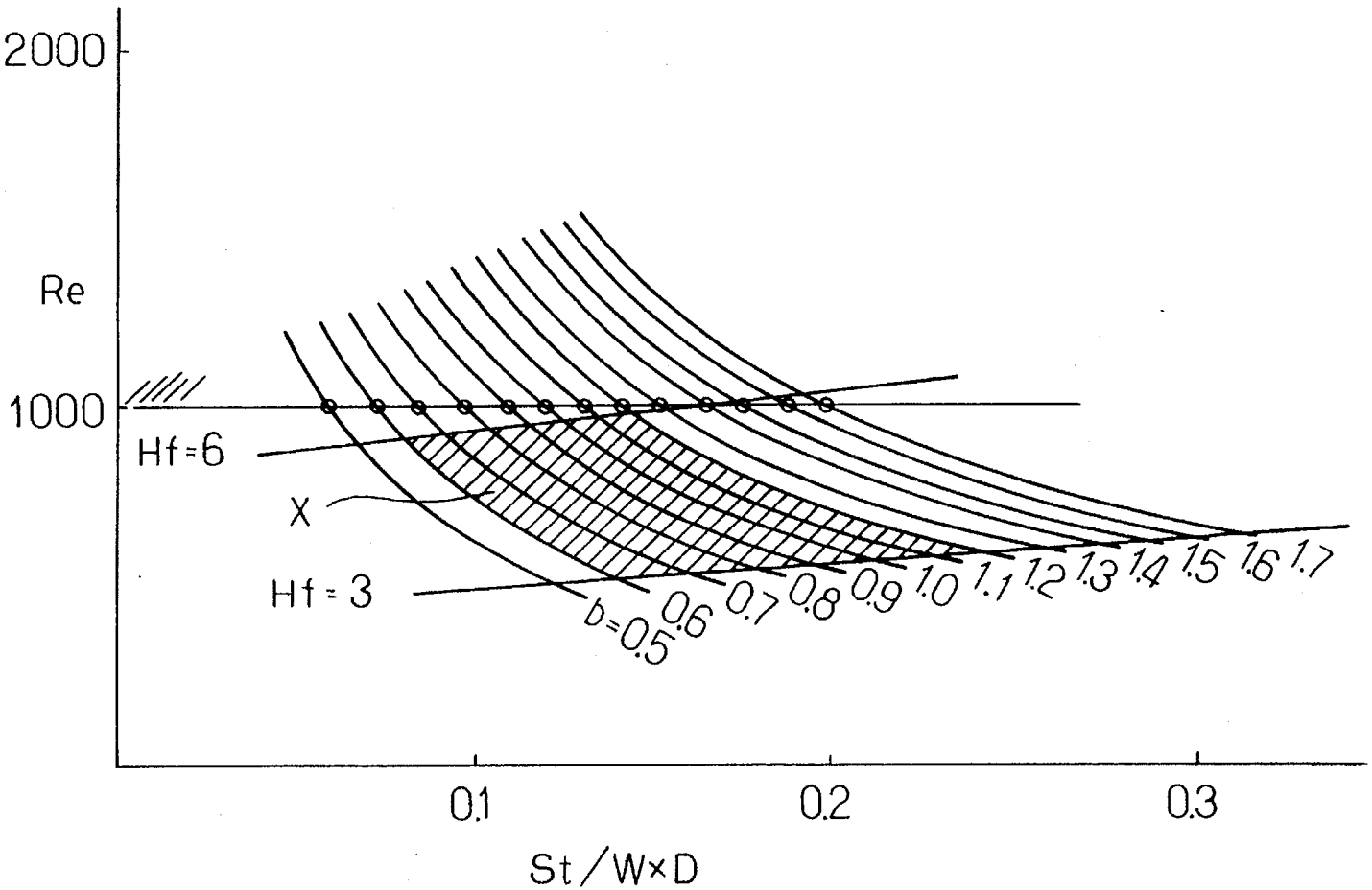
FIG. 11 is a graph illustrating the relationship among the total cross-sectional area ratio of flat tubes Reynold's number and corrugated fin height of the heat exchanger of the embodiment according to the present invention.

Based on the above results, the optimum range of the ratio of the total cross-sectional flow passage area of the flat tube 2*a* (St/W×D) is obtained from the optimum range of the fin height Hf (3–6 mm) and the optimum range of the thickness b (0.6–1.2 mm). The shaded portion X in FIG. 11 indicates the optimum range.

Figure 12:
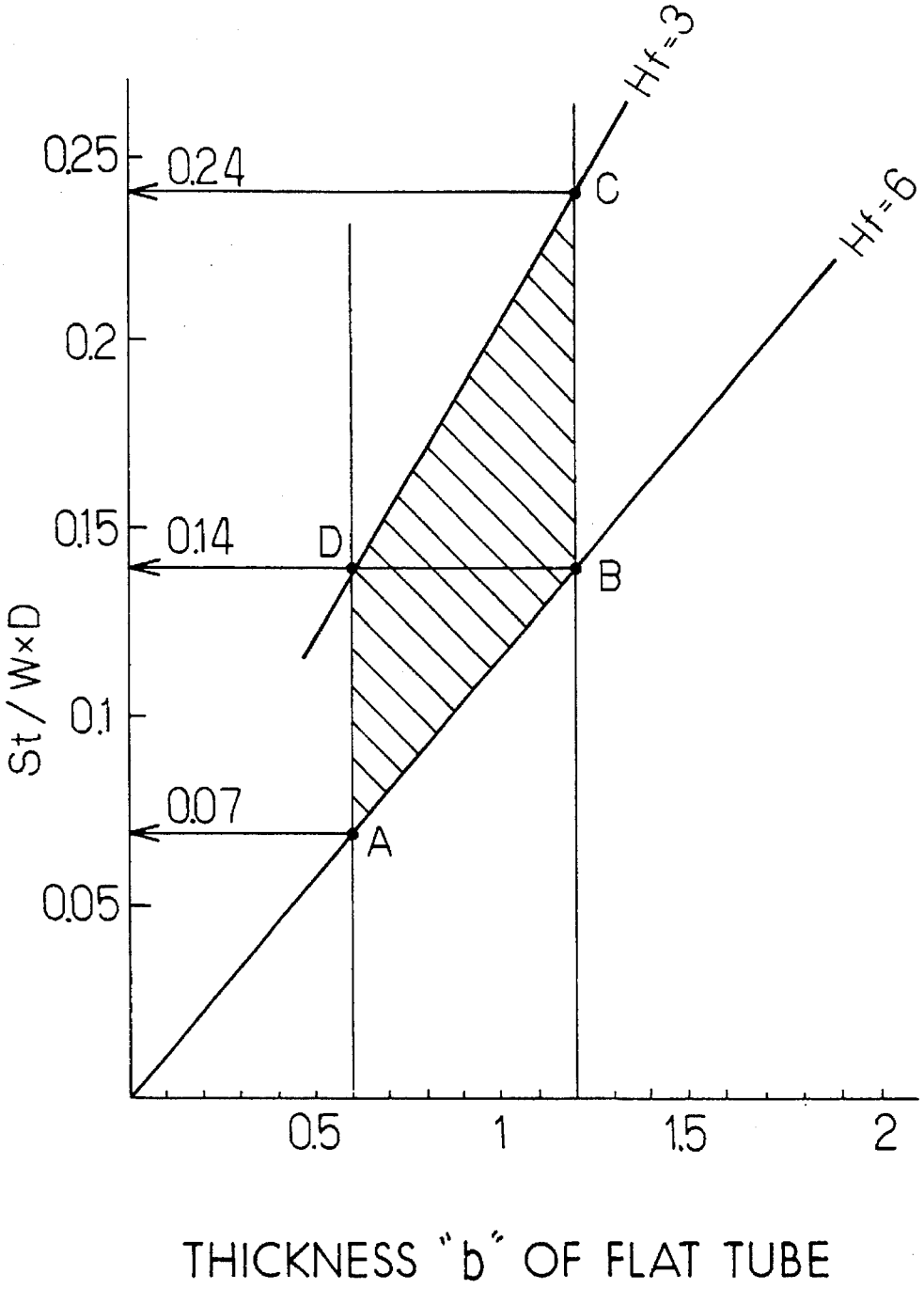
FIG. 12 is a graph illustrating the relationship among the total cross-sectional area ratio of flat tubes, inner thickness of flat tube and corrugated fin height of the heat exchanger according to the present invention.

As illustrated in FIG. 12, when this optimum range is rewritten by taking the total cross-sectional flow passage area ratio (St/W×D) of the flat tubes 2*a* as the ordinate and the height "b" of the flat tube 2*a* as the abscissa, in a combination of the optimum fin height (Hf=3–6 mm) and the optimum tube thickness (b=0.6–1.2 mm), the total cross-sectional flow passage area ratio (St/W×D) of the flat tubes 2*a* is identical to the shaded portion enclosed with A, B, C and D in FIG. 12, i.e., the range of 0.07–0.24.

By setting the total cross-sectional flow passage area ratio (St/W×D) of the flat tubes 2*a* within the shaded portion enclosed with A, B, C and D, it is possible to control the Reynold's number Re of the flow passage of the flat tube 2*a* to 1000 or less within the range of hot water flow quantity for the heat exchanger 2 (maximum 16 lit/min), thereby keeping the hot water flow within the flow passage of the flat tube 2*a* laminar constantly.

Figure 13:
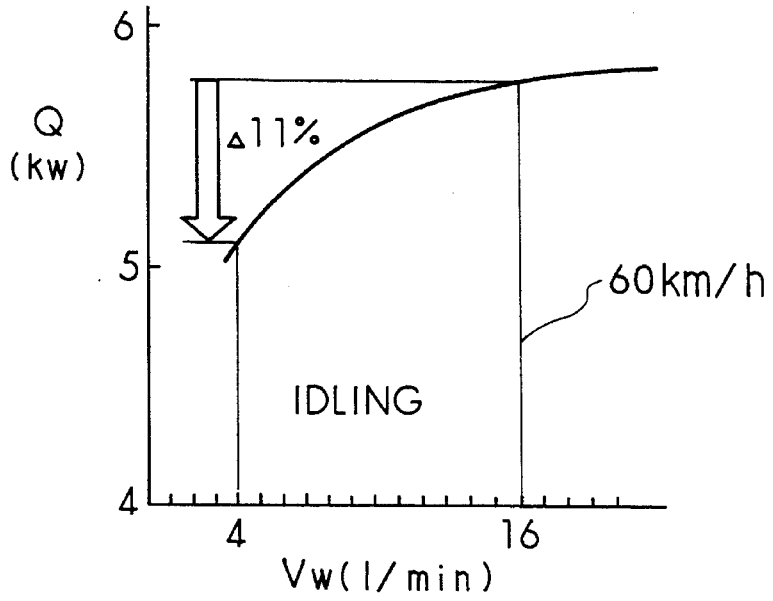
FIG. 13 is a graph illustrating the relationship between the hot water flow quantity and heat radiation performance of the heat exchanger of the embodiment according to the present invention.

Now, the heat radiation performance of the heat exchanger 2 specially designed based on the above specification range is illustrated in FIG. 13. The heat exchanger 2 illustrated in FIG. 13 is dimensioned to the width W=180 mm, height H=180 mm and thickness D=27 mm in the core portion 2*c*, the height Hf=4.5 mm in the corrugated fin 2*b*, and the height b=0.9 mm in the flat tube 2*a*, which are the central values of the optimum range, respectively.

Figure 1:
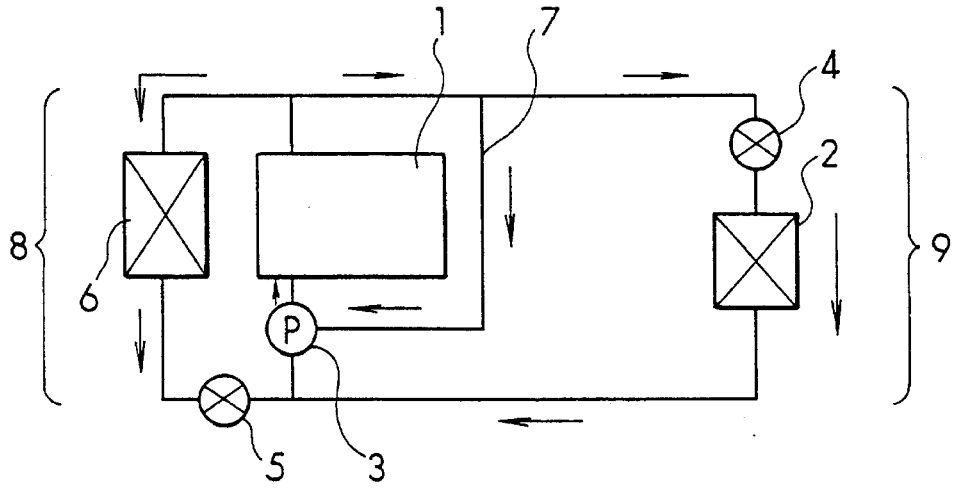
FIG. 1 PRIOR ART
FIG. 1 is a diagram illustrating an engine cooling water circuit.
Figure 2:
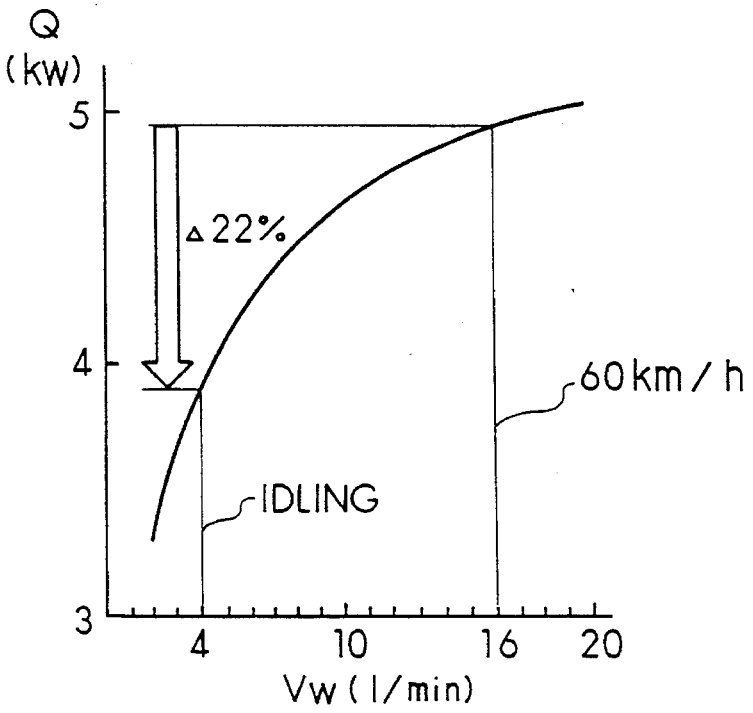
FIG. 2 PRIOR ART
FIG. 2 is a graph illustrating the relationship between the hot water flow quantity and heat radiation performance of the conventional heat exchanger.

The total cross-sectional flow passage area ratio (St/W×D) of the flat tube 2*a* is 14.5. The heat radiation performance Q of the heat exchanger 2 specially designed as the above was obtained. As a result, as illustrated in FIG. 13, the heat radiation performance Q at a low flow quantity (4 lit/min when the vehicle is idling) decreased by as small as approximately 11% down from the heat radiation performance Q at a high flow quantity (16 lit/min when the vehicle is running at 60 km/h), which is a half or less as much as the reduction percentage (22%) in heat radiation performance of the conventional heat exchanger 2 illustrated in FIG. 2. As clearly understood, the performance is largely improved.

Figure 14:
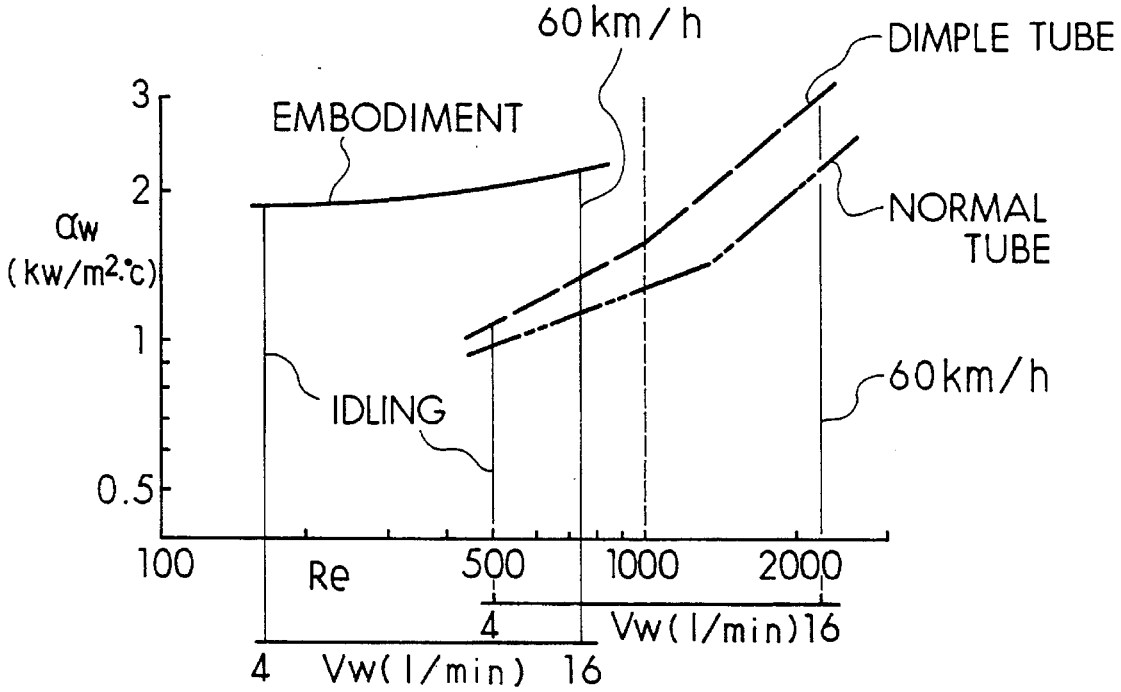
FIG. 14 is a graph illustrating the relationship among the hot water flow quantity, Reynold's number and water side heat transfer of the heat exchanger of the embodiment according to the present invention as compared to the conventional type.

In FIG. 14, the relationship between the Reynold's number Re and water side heat transfer rate αw of the heat exchanger 2 based on the specifications defined in FIG. 13 is summarized. As understood from FIG. 14, the heat exchanger 2 according to the present invention is used within a complete laminar region with the Reynold's number Re of 1000 or less, where the hot water flow quantity is 4–16 lit/min, and furthermore, the water side heat transfer rate αw within the low flow quantity region is largely improved as compared to the conventional heat exchanger.

Next, an embodiment where the heat exchanger 2 designed based on the above specifications and applied to an automotive air conditioning system is described with reference to FIG. 15. The core portion 2*c* is composed of the flat tubes 2*a* and the corrugated fin 2*b*. Each flat tube 2*a* is supportably connected to core plates 2*d* at both ends. Tanks 2*e* and 2*f* are connected to the core plates 2*d*, respectively. Further, inlet and outlet pipes 2*g* and 2*h* are detachably connected to the tanks 2*e* and 2*f* by seal joints 2*i* and 2*j*, respectively.

Figure 15:
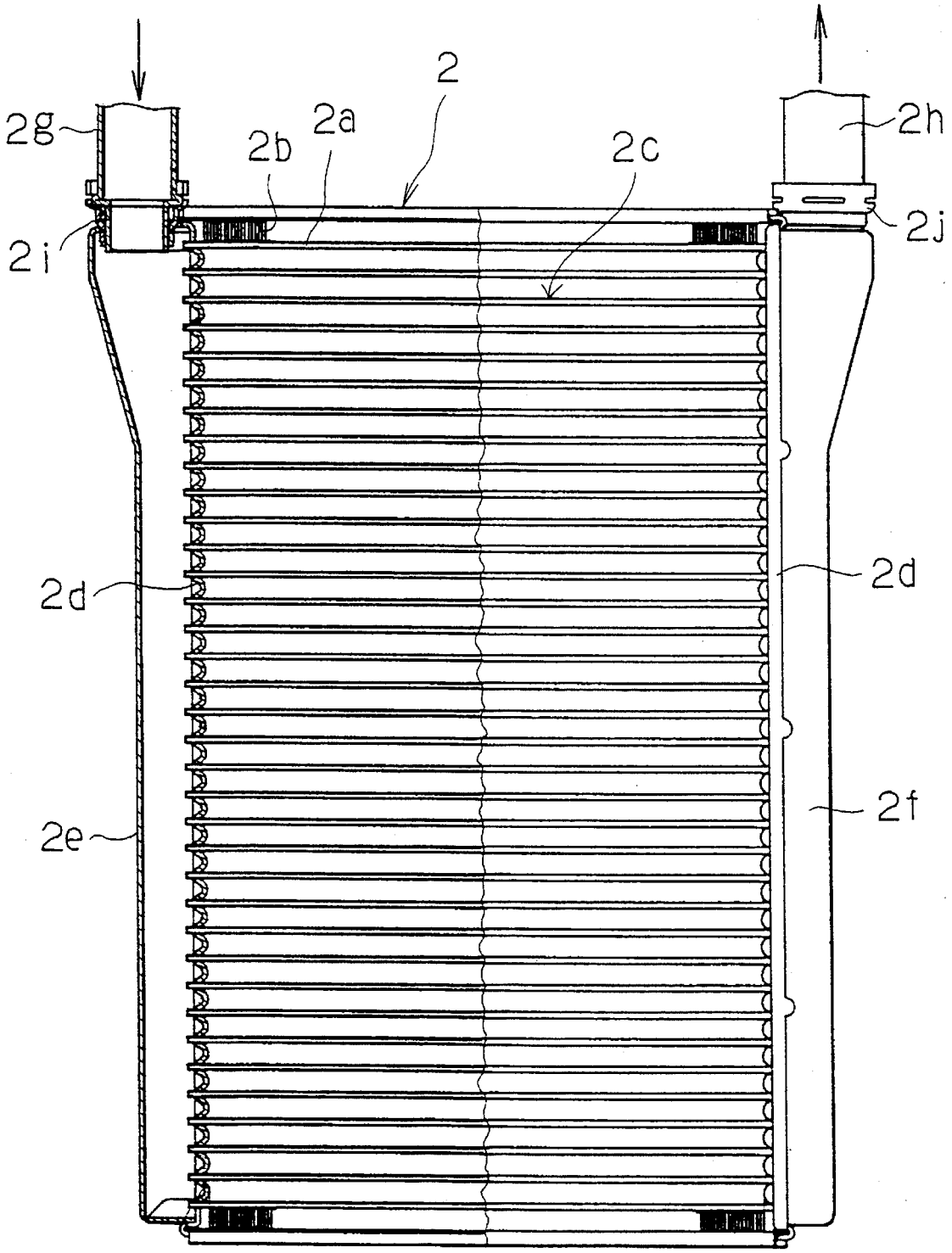
FIG. 15 is a partial cross-sectional front view illustrating an embodiment of the heat exchanger according to the present invention.

In FIG. 15, for example, when the pipe 2*g* is connected to the hot water inlet side of the hot water circuit of the engine 1, the hot water from the hot water inlet pipe 2*g* flows through the hot water inlet tank 2*e*, the flat tubes 2*a*, the hot water outlet tank 2*f* and the hot water outlet pipe 2*h* in this order.

That is, a one-way flow type heat exchanger (full-pass type) is configured in such a manner that the hot water inlet tank 2*e* is disposed at an end portion of the core portion 2*c* over the overall width direction, the hot water outlet tank 2*f* is disposed at the other end portion of the core portion 2*c* over the overall width direction, and the hot water flows only in one direction from the inlet tank 2*e* to the outlet side tank 2*f* through the flat tube 2*a*.

In the heat exchanger 2 configured as the one way flow type (full-pass type), it is easily possible to decrease the cross-sectional area A per flat tube 2*a* and increase the total cross-sectional area St of the entire flat tubes 2*a* simultaneously.

The heat exchanger 2 illustrated in FIG. 15 is made of aluminum. The flat tube 2*a*, the core plate 2*d* and the tanks 2*e* and 2*f* are formed from aluminum-clad material in which the aluminum core material is clad with brazing material at one or both sides. On the other hand, the corrugated fin 2*b* is formed from aluminum material which is not clad with brazing material. The heat exchanger 2 is integrally constructed by temporarily assembling these components, heating the assemblies within a brazing furnace to a brazing temperature, and then integrally brazing the assemblies.

Here, it is preferable in view of heat transfer rate, strength, etc. that the thickness of the aluminum flat tube 2*a* being set to a range of 0.2–0.4 mm and the thickness of the aluminum corrugated fin 2*b* being set to a range of 0.04–0.08 mm.

Figure 16A:
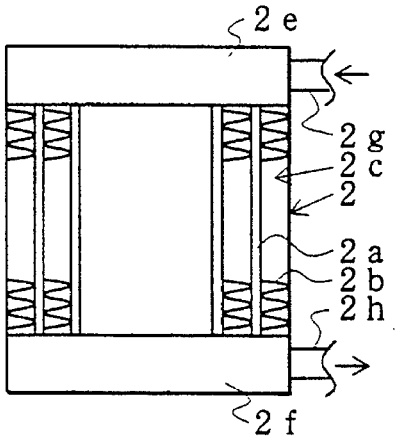
FIGS. 16A–16F are schematic front views illustrating modifications of the heat exchanger according to the present invention.
Figure 16B:
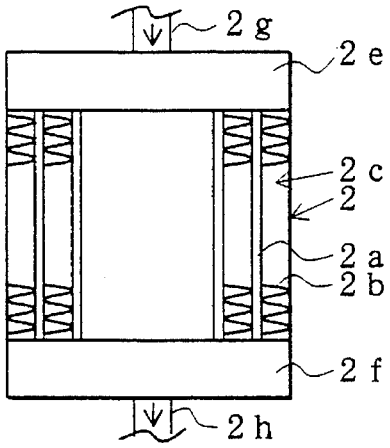
Figure 16C:
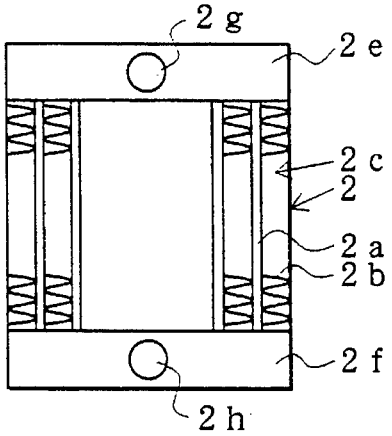

FIGS. 16A–16F illustrate modifications of the tank portion of the heat exchanger 2. FIGS. 16A to 16C illustrate modifications in which the width of the core portion 2*c* is set the same as that of the tanks 2*e* and 2*f* and the positions of the hot water inlet and outlet pipes 2*g* and 2*h* are modified differently.

Figure 16D:
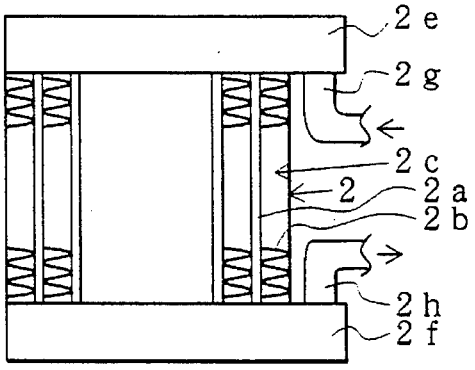
Figure 16E:
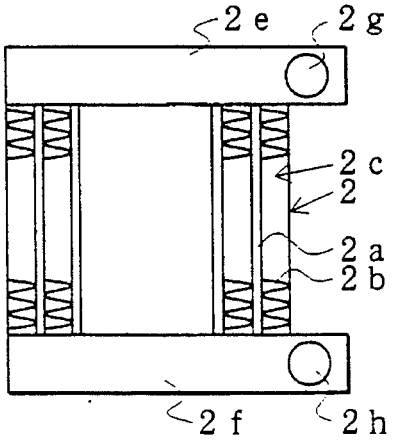
Figure 16F:
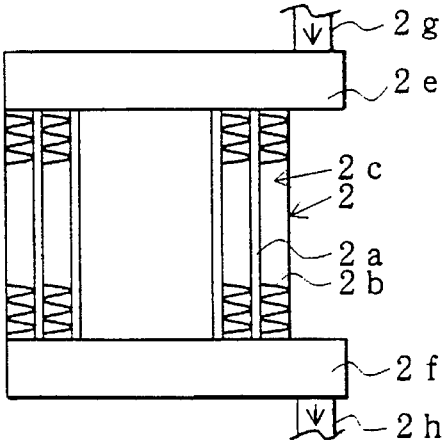

FIGS. 16D to 16F illustrate modifications in which each width of the tanks 2*e* and 2*f* is set larger than that of the core portion 2*c* and the hot water inlet and the positions of the outlet pipes 2*g* and 2*h* are modified differently.

In FIGS. 15 and 16, since the shape of the heat exchanger 2 is symmetric with respect to the hot water flow direction of the core portion 2*c*, the tank 2*e* may be disposed on the hot water outlet side and the tank 2*f* may be disposed on the hot water inlet side contrary to the above embodiment.

The present invention having been described should not be limited to the disclosed embodiments, but it may be modified in many other ways without departing from the scope and the spirit of the invention. Such changes and modifications are to be understood as being included with the scope of the present invention as defined by the appended claims.

What is claimed is:

1. A corrugated fin type heat exchanger for heat exchanging hot water with air, said corrugated fin type heat exchanger comprising:

a plurality of flat tubes disposed in parallel relation with respect to a flow direction of the air; and at least one corrugated fin disposed between each pair of said flat tubes and connected thereto;

said plurality of flat tubes and said corrugated fin composing a core portion, wherein a height of a flow space within the flat tube is in a range of 0.65–1.2 mm;

a height of said corrugated fin is in a range of 3–6 mm; and a ratio (St/W×D) of the cross-sectional area (W×D) expressed by an overall width dimension (W) and a thickness dimension (D) of said core portion to a total cross-sectional flow passage area (St) of said plurality of flat tubes is set to a range of 0.07–0.24 according to said height of the flow space within said flat tube and said height of said corrugated fin.

2. A corrugated fin type heat exchanger according to claim 1, wherein said heat exchanger is constructed and arranged to be used in an automotive air conditioning system in which said hot water is circulated by a water pump driven by an automotive engine, and the Reynold's number being set to 1000 or less when a flow quantity of said hot water passing trough said core portion is 16 lit/min.

3. A corrugated fin type heat exchanger according to claim 1, wherein said flat tubes and said corrugated fins are made of aluminum, a wall thickness of said flat tube is set to a range of 0.2–0.4 mm; and a wall thickness of said corrugated fin is set to a range of 0.04–0.08 mm.

4. A corrugated fin type heat exchanger according to claim 1, further comprising:

a hot water inlet tank disposed at one end of said core portion, for introducing said hot water into said flat tube; and a hot water outlet tank disposed at the other end of said core portion, for receiving said hot water flowing from said flat tubes, wherein said core portion is constructed in such a manner that said hot water flows only in one direction from said hot water inlet tank to said hot water outlet tank.

5. A corrugated fin type heat exchanger according to claim 4, further comprising:

an inlet pipe connected to said hot water inlet tank to introduce said hot water into said inlet tank;

an outlet pipe connected to said hot water outlet tank to lead said hot water out of said outlet tank.

6. A corrugated fin type heat exchanger according to claim 5, wherein said inlet pipe and said outlet pipe extend in a longitudinal direction of said hot water inlet tank and said hot water outlet tank, respectively.

7. A corrugated fin type heat exchanger according to claim 5, wherein said inlet pipe and said outlet pipe extend in a lateral direction of said hot water inlet tank and said hot water outlet tank, respectively.

8. A corrugated fin type heat exchanger according to claim 1, wherein said heat exchanger is constructed and arranged to be used in an automotive air conditioning system in which said hot water is circulated by a water pump driven by an automotive engine and passes through a radiator for cooling said hot water by heat exchanging with air and being disposed in a cooing water pipe communicating between said engine and said radiator, and said heat exchanger being disposed in a hot water pipe arranged in parallel with said cooling water pipe.

* * * * *

UNITED STATES PATENT AND TRADEMARK OFFICE

CERTIFICATE OF CORRECTION

PATENT NO. : 5,564,497

DATED : October 15, 1996

INVENTOR(S) : Fukuoka et al

It is certified that error appears in the above-indentified patent and that said Letters Patent is hereby corrected as shown below:

On the title page,item [54] and col. 1, lines 1-2: the title should read —CORRUGATED FIN TYPE HEAT EXCHANGER—.

Signed and Sealed this

Eleventh Day of March, 1997

*Attest:*

Bruce Lehman

BRUCE LEHMAN

*Attesting Officer*

*Commissioner of Patents and Trademarks*